United States Patent [19]

Adams

[11] 4,008,536

[45] Feb. 22, 1977

[54] DETACHABLE GUN SIGHT MOUNTS

[76] Inventor: Jean M. Adams, P.O. Box 193, Neenah, Wis. 54956

[22] Filed: Mar. 10, 1975

[21] Appl. No.: 557,054

[52] U.S. Cl. ..... 42/1 S; 33/233
[51] Int. Cl.[2] ..... F41G 1/46
[58] Field of Search ..... 42/1 S; 33/233

[56] References Cited

UNITED STATES PATENTS

| | | | |
|---|---|---|---|
| 744,651 | 11/1903 | Vickery | 33/233 |
| 2,498,329 | 2/1950 | Barnes | 42/1 S |
| 2,781,583 | 2/1957 | Grimble | 42/1 S |
| 2,795,048 | 6/1957 | Seymour et al. | 33/233 |
| 2,874,504 | 2/1959 | Martinek | 42/1 S |
| 3,193,932 | 7/1965 | Johnson | 33/233 |
| 3,840,995 | 10/1974 | Freiling | 42/1 S |

*Primary Examiner*—Charles T. Jordan
*Attorney, Agent, or Firm*—Russell L. Johnson

[57] ABSTRACT

A readily attachable and detachable gun sight mount for mounting rifle-like sights to a shotgun. The invention provides shotguns, with ventilated ribs, with a gun sight mount that is securely clamped to and accurately indexed with the ventilated rib. The invention provides shotguns, not provided with a ventilated rib, with a gun sight mount that is securely clamped to the gun barrel and is accurately indexed with existing structures of the shotgun barrel. The preferred gun sight mounts of this invention incorporate for their employment a two part clamp which is accurately formed to fit the structural parts of the gun barrel to which the gun sight mount is to be clamped, a means for holding the parts of the clamp in alignment during assembly with the gun barrel, a pair of fasteners, a portion of the gun sight mount formed to index to and mechanically engage with an existing part of the gun barrel, and an appropriate portion of the mount suitably formed to receive and securely mount a gun sight to the gun sight mount.

13 Claims, 12 Drawing Figures

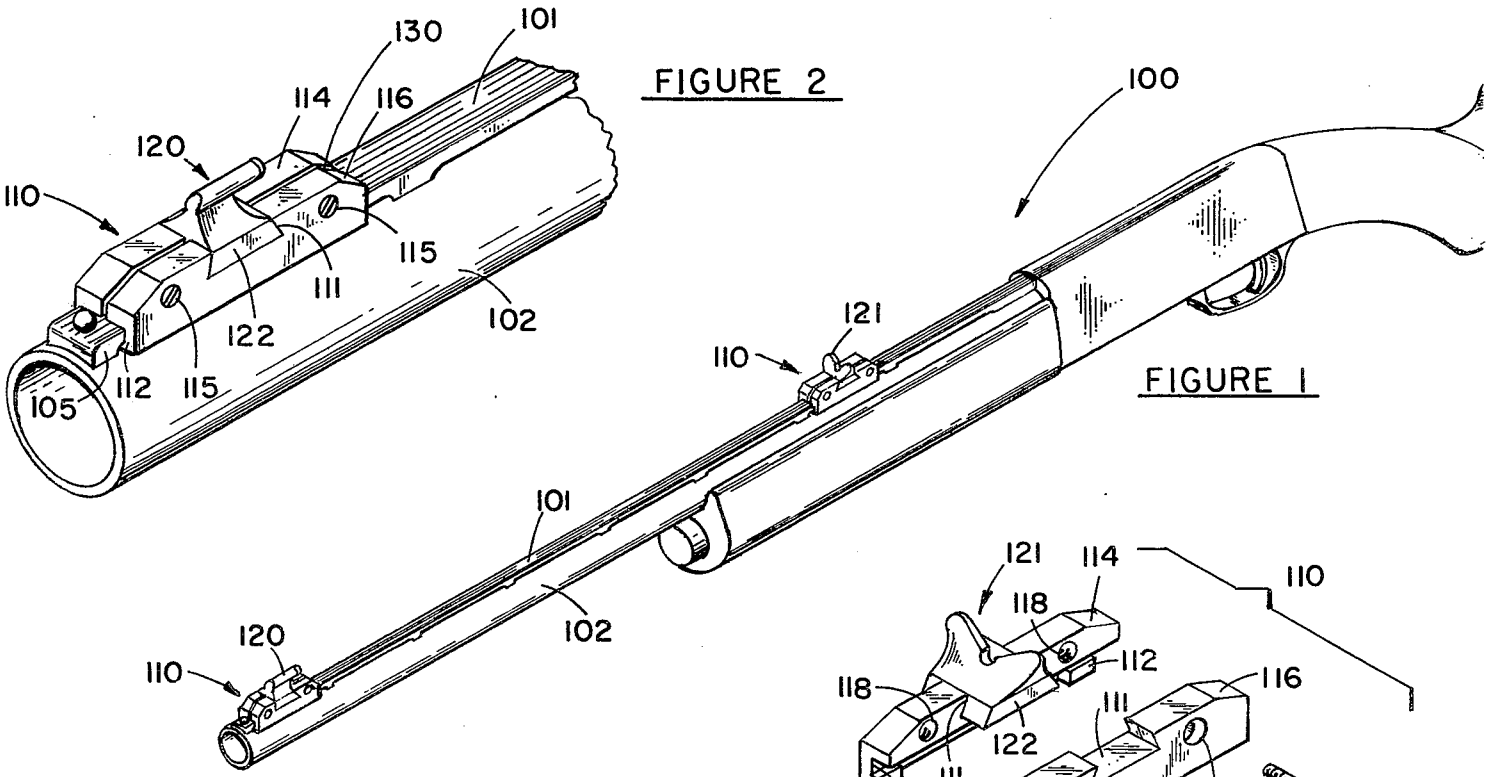
FIGURE 1
FIGURE 2
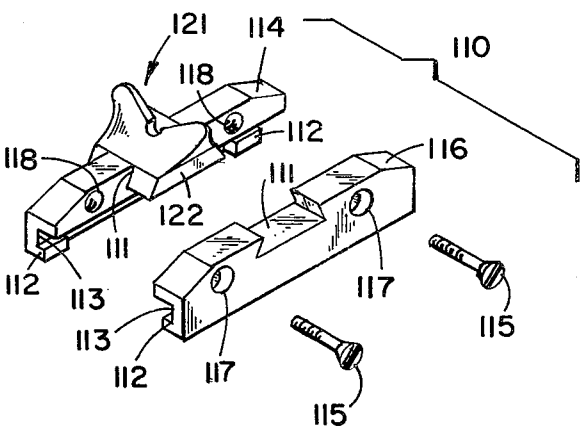
FIGURE 3

FIGURE 4
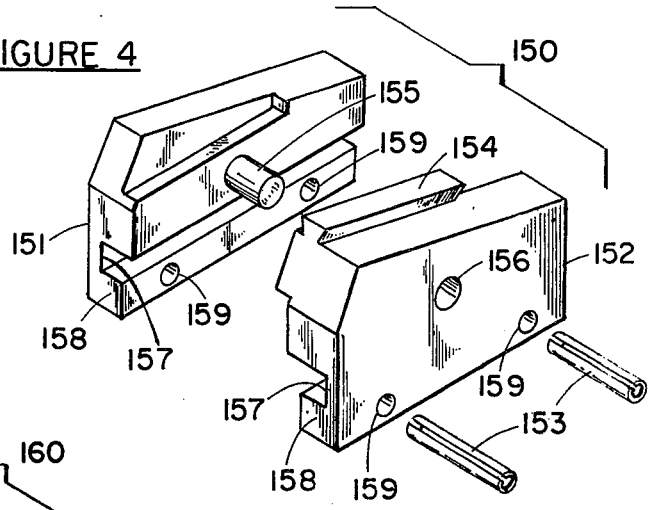
FIGURE 5
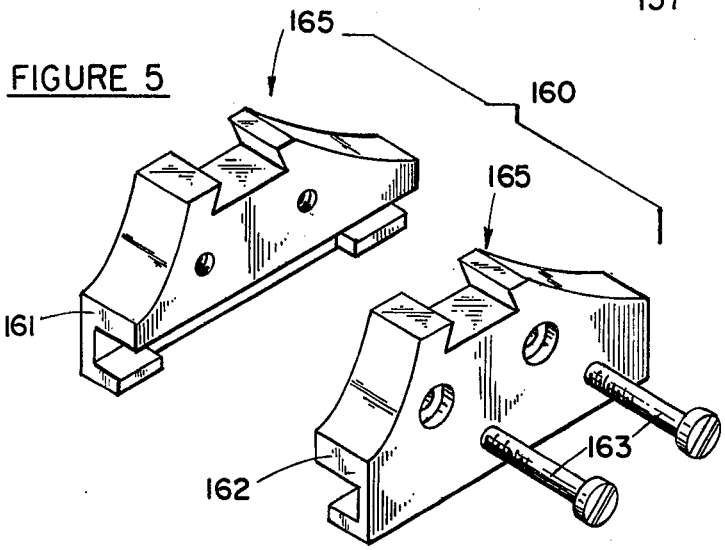
FIGURE 6
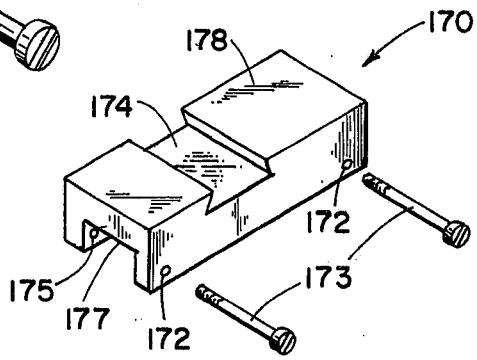
FIGURE 7
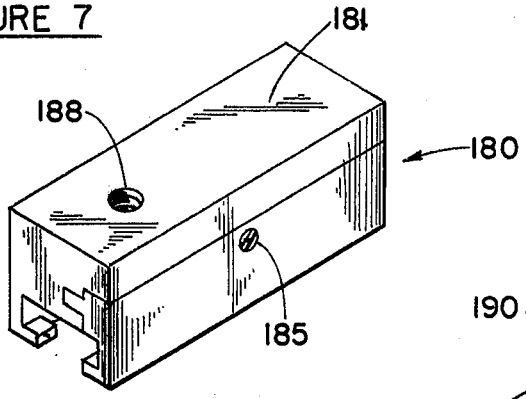
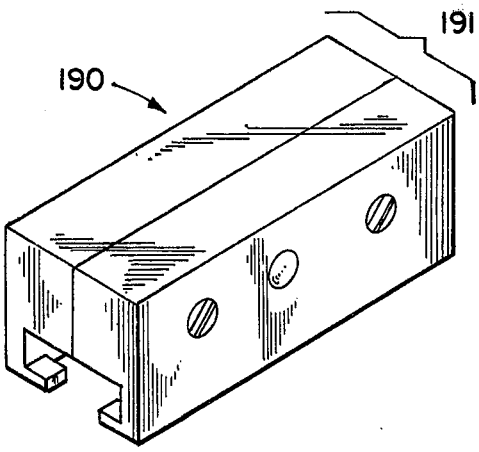
FIGURE 8

DETACHABLE GUN SIGHT MOUNTS

BACKGROUND OF THE INVENTION

Firearms that are discharged from the shoulder have generally been divided into two separate groups; rifles and shotguns. Rifles may be characterized as those firearms that are discharged from the shoulder and fire a single projectile a considerable distance at a specific target point and are aligned with said target point by means of accurate sights. Shotguns may be characterized as those firearms that are discharged from the shoulder and fire multiple projectiles a moderate distance at a specific target location and are aligned with said target location by means of pointing aids called ball or bead sights.

The advent of the rifled slug in the 1930's slightly blurred the distinction between rifles and shotguns. The rifled slug's relatively high mass and low muzzle velocity imparted to it the characteristics of relatively high shocking and knock down capabilities. At short ranges (less than 100 yards) these characteristics made the rifled slug an ideal load for the taking of deer in brushy and swampy areas.

It was almost universally believed at that time that the effective range of a rifled slug was about 50 yards. It has since been shown that much of the apparent ineffectiveness of the rifled slug at ranges beyond 50 yards was due in part to the marksman's inability to aim a shotgun accurately using only the ball or bead sight provided on most shotguns.

In the 1940's and 1950's many local governments became concerned about the use of high powered rifles in their areas. As a result of these concerns many governmental areas have been designated "shotgun only'-'areas for deer hunting. This compulsory use of the shotgun and slug for the taking of deer caused sportsmen and arms manufacturers to intensify their search for a means to provide a more rifle-like set of sights for use with a shotgun when the shotgun is employed in the shooting of rifled slugs. For reasons discussed in detail herein, a simple exchange back and forth between conventional shotgun sights and conventional rifle sights has not heretofore been shown to be practicable.

FIELD OF THE INVENTION

This invention relates to a readily attachable and detachable gun sight mount for mounting rifle-like sights to a shotgun. More specifically this invention relates to gun sight mounts which may be paired to provide a means for mounting both front and rear rifle-like sights to a shotgun. More specifically this invention relates to a gun sight mount which may be accurately positioned on and securely attached to a shotgun without the need for modification of the shotgun barrel or its associated structures. Still more specifically this invention relates to a gun sight mount that may be readily attached to and removed from a shotgun by a person of ordinary mechanical skill using tools commonly found in a home workshop.

DESCRIPTION OF THE PRIOR ART

Sights are conventionally attached to a firearm by the manufacturer. These sights are accurately and securely attached to the firearm by skilled craftsmen. The mounting of these sights is intended to be more or less permanent. The skills and tools required to change or modify gun sights of the conventional designs are not found to be possessed by the average nimrod.

The relatively thin, slightly tapered tube of a shotgun barrel does not ordinarily permit the depth of machining needed for dovetail grooves or screw holes such as those conventionally used to mount rifle sights to rifles. The most common means for mounting rifle-like sights to a shotgun is to permanently attach a sight mount to the outside tubular of the shotgun barrel by means of silver soldering, brazing, sweating or the like. Rifle-like sights are then securely and accurately mounted in the sight mounts. These sights serve their intended purpose well. Shotguns with rifle-like sights permanently mounted were introduced into the market in the early 1960's and were almost instant successes. These "slug guns" are widely accepted today and most major manufacturers of shotguns provide the market with conventional shotguns and shotguns with rifle-like sights permanently mounted to the barrel. Most major manufacturers also provide at least one model shotgun with two interchangeable barrels; one barrel with conventional ball shotgun sights and one barrel with rifle-like sights permanently mounted to the barrel.

The hunter who already possesses a shotgun for hunting small game and that shotgun is otherwise adequate for firing slugs does not have, at present, a means for providing his shotgun with a pair of rifle-like sights that can be conveniently installed and removed.

Detachable fron sight pointing aids for shotguns are provided in the prior art. U.S. Pat. No. 744,651 to Vickery provides a split circumferential band clamp as an attachment means. U.S. Pat. No. 2,498,329 to Barnes provides a split circumferential band clamp as an attachment means and utilizes the front bead sight as a radial and longitudinal index. U.S. Pat. No. 2,781,583 to Grimble provides a continuous circumferential band and a set screw as an attachment means and utilizes the front bead sight as a radial and longitudinal index. An adherable mount for a frontsight pointing aid is provided by Normark Corporation of Minneapolis, Minn. The mount is adhered to the ventilated rib of a shotgun and an optical pointing aid is detachably mated to the mount.

In order to aim a firearm, as opposed to pointing a firearm, it is necessary that the firearm be provided with two accurately located points with which to align the target. In using conventional iron sights these points are provided by the front and rear sights. A readily detachable rear rifle-like sight for a shotgun is not found in the art. A receiver rear sight which utilizes screw holes machined in the receiver of some shotguns is provided by the Williams Gun Sight Company of Davidson, Mich.

While prior art devices show features such as; a sight mount as opposed to a sight, detachability, indexing to existing gun barrel structures, engagement with existing gun barrel structures, accurate alignment of parts, no need to modify existing gun barrel structures, secure noncircumferential clamping, etc., no one of the prior art devices possesses all of the above features. Additionally the prior art does not provide a detachable rear sight or rear sight mount that does not require the disturbing of existing firearm structures for its employment. As a consequence of the unavailability of a suitable detachable rear sight or sight mount, the prior art does not provide a pair of detachable rifle-like sights or sight mounts. It is one of the objects of this invention to provide a suitable pair of detachable sight mounts for mounting front and rear rifle sights to a shotgun. Indeed, it is within the scope of several embodiments of this invention to provide a detachable gun sight mount which may be without modification, employed to mount either front or rear rifle sights to a shotgun.

SUMMARY OF THE INVENTION

The concept of a readily attachable and detachable pair of rifle-like sights for a shotgun to be employed when the shotgun is to be used as a rifle to fire rifled slugs is a readily understood and easily acceptable concept. The means to achieve this end is made elusive by the diverse and sometimes seemingly contradictory requirements for a satisfactory pair of detachable rifle-like sights for a shotgun.

The availability of sufficient metal in a shotgun barrel to permit conventionally machined gun sight mounting grooves and holes has already been discussed. The need to provide the means for mounting a pair of sights as opposed to a single sight has also been discussed.

The gun sights should be attachable by the nimrod possessing ordinary mechanical skill and utilizing tools that would ordinarily be readily available to him. Gun sights that require the services of a gunsmith for mounting and dismounting would necessitate a cost to the user that would be prohibitive.

The gun sights should be accurately positionable both radially and longitudinally. The prudent nimrod sights-in his weapon each season before going out to hunt. If this sighting-in requires more than small minor adjustments each season then the cost and inconvenience of the detachable sights would be prohibitive.

The gun sights should be securely attached to the shotgun. If the sights do no remain securely fixed, then misalignment is possible. Misalignment is highly undesirable in gun sights. There are two common causes of misalignment of detachable gun sights. The first cause is bumping the jarring during transport. The second cause is the jar of the recoil which tends to urge the gun sight forward each time the gun is fired.

The sights should be light in weight so as not to materially affect the weight and balance of the shotgun.

The sights should have smooth lines and blend with the structures of the shotgun. The smooth lines not only serve the esthetics of the shotgun but also serve to minimize the tendency of the sights to catch or hang up on brush and the like.

In addition to the functional requirements listed above a pair of detachable gun sights should meet some significant commercial requirements.

The sight mounts should possess a high degree of universality. It is not uncommom for a manufacturer to provide 25 to 50 models of a single sight style in order to meet the mounting requirements of different makes and models of guns. It is not desirable to further multiply the number of sights needed to maintain a sufficient inventory to meet the user's needs.

The gun sight mounts of this invention satisfy the diverse requirements listed above.

The most preferred embodiment of this invention is a gun sight mount which clampably attaches to the ventilated rib of a shotgun barrel. The gun sight mount provides sufficient material for the machining of conventional rifle sight mounting means. The mount is radially indexed by the rib and may be longitudinally indexed to a rib support. Alignment of the sights is assured by both sights being mounted to the ventilated rib. The mount may be employed for mounting either a front or a rear sight. Ventilated ribs are normally the same size for all models and gauges of shotgun made by a single manufacturer. Although there are some shotguns with "odd" sized ribs the vast majority of ventilated ribs used on shotguns today fall into a relatively small set of sizes.

The term "detachable" as used herein refers to an attachment to a gun barrel structure which serves to provide the necessary physical structures for mounting a gun sight and said attachment is removable when such removal is desired. The detachable sight mount of this invention is an intermediate structure that attaches to the gun and to which the gun sight is attached. The mount of this invention may be provided with a sight mated to the mount or the mount may be provided with preformed mounting dovetail or grooves or screw holes or the like. Alternatively the sight mount may be provided in blank to be machined to suit the specialized needs of the user.

The term "gun barrel structure" as used herein is intended to include the substantially tubular barrel of the shotgun and all structures fixedly attached thereto, such as; bead sights, ribs, and various depending lugs or magazine attachments and the like.

Sight styles and preference for such styles change from time to time. For example, the so called ramp front sight is now a commonly sought after sight. The sight mount of this invention may be fabricated to conform in appearance to that of most styles of rifle sights although the mount attachment and alignment means may remain substantially unchanged.

For guns not provided with a ventilated rib a preferred embodiment of the invention comprises a clamp which encirles more than 180° of the barrel circumference and a portion or portions of the clamp or mount are suitably machined as indexes to engage existing structures of the gun barrel.

For example; the front bead sight mount for a slide action shotgun may be used for the radial and longitudinal index and to insure against misalignment. The depending lug which is common on most slide action shotguns may be utilized to provide the rear sight mount with a fixed index on the gun barrel by which radial and longitudinal indexing may be had along with a mechanical engagement against dislodgement.

When a suitable mechanical index is not available on the gun barrel a serviceable detachable gun sight mount may be provided by placing adhesive on the surfaces of contact between the mounting clamp and the shotgun barrel. In the absence of a mechanical index the possibility of the sight creeping into misalignment exists. However, if care is taken in handling this embodiment provides a serviceable sight mount but is not preferred. Surfaces of the gun sight mount which contact surfaces of the gun barrel structures may have a thin cushioning coating or lining which will serve to minimize the potential for the gun sight mount to mar the surfaces of the gun barrel structures. This coating also can serve to minimize the effects of slight variances in the mating of the gun sight mount to the gun barrel structure.

BRIEF DESCRIPTION OF THE DRAWINGS

FIG. 1 is a pictorial view which shows a shotgun with a ventilated rib having mounted to said rib a preferred sight mount of this invention. The sight mount is employed to mount both front and rear rifle-like sights.

FIG. 2 is an enlarged view of the front sight mount of FIG. 1.

FIG. 3 is an exploded view of the rear sight mount of FIG. 1.

FIG. 4 is an exploded pictorial view of an embodiment of the sight mount of this invention showing alternative fastening, alignment, and rib receiving means and a dovetail ramp for mounting a sight.

FIG. 5 is an exploded pictorial view of the sight mount of this invention having the sight mount shaped to mount a ramp front sight.

FIG. 6 is an exploded pictorial view of a unitary embodiment of this sight mount of this invention.

FIG. 7 is a pictorial view of another sight mount of this invention.

FIG. 8 is a pictorial view of the sight mount of this invention with the mounting surface provided in blank.

DESCRIPTION OF THE PREFERRED EMBODIMENTS

Figure 9:
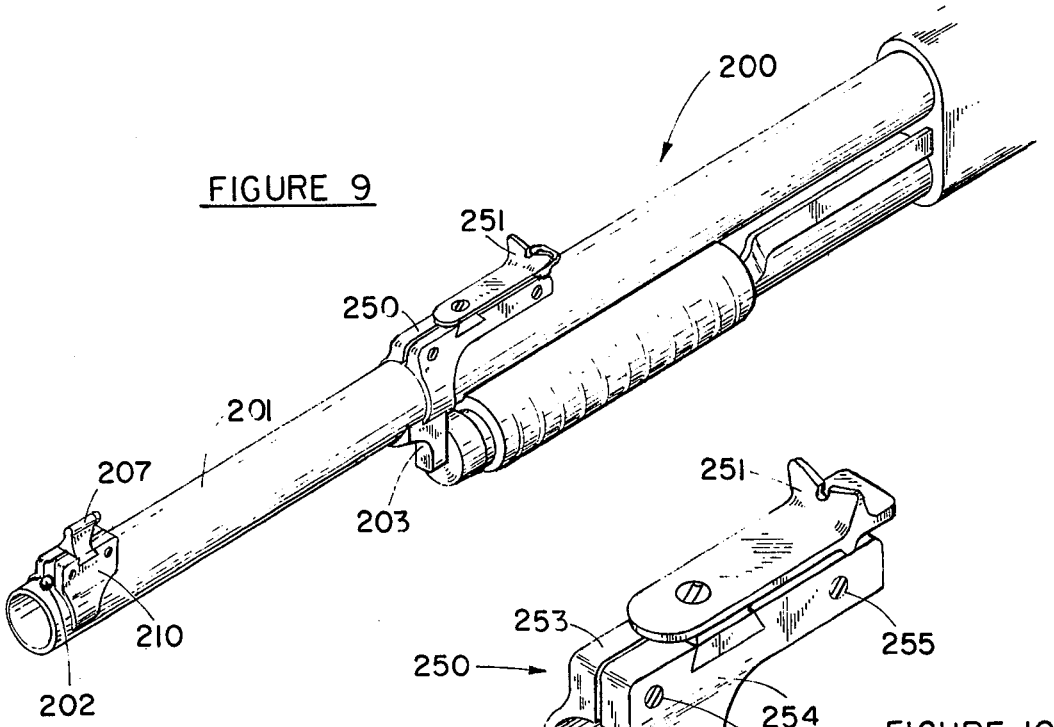
FIG. 9 is a pictorial view of a shotgun having clamped to the tubular barrel of the shotgun a pair of gun sight mounts made according to a preferred embodiment of this invention.

Reference may now be made to FIGS. 1 through 3 which illustrate a preferred embodiment of the invention. In FIGS. 1 through 3 like numbers refer to like parts. Referring now to FIG. 1 shotgun 100 is provided with a ventilated rib 101 attached to barrel 102. Gun sight mounts 110 are clampably attached to ventilated rib 101. Sight mounts 110 have mounted thereto post front sight 120 and notch rear sight 121 as shown.

Referring now to FIG. 2 gun sight mount 110 has machined therein dovetail groove 111 which may be the ⅜ inch dovetail groove which is standard in the industry. Front sight 120 has at its bottom dovetail 122. Dovetail 122 is slightly tapered along its length so that it will enter the mating dovetail groove 111 with ease but will wedge fit into the groove as the sight nears the midposition in dovetail groove 111. Lip 112 of gun sight mount 110 is mechanically engaged with rib support 105 of ventilated rib 101 thereby providing longitudinal indexing of gun sight mount 110. Gun sight mount 110 is maintained is clamping engagement with ventilated rib 101 by means of screws 115.

When gun sight mount 110 is assembled with ventilated rib 101 first body member 114 preferably does not contact second body member 116. A gap 130 of a few ten thousandths of an inch is provided between body member 114 and body member 116 to insure that when screws 115 are drawn into secure engagement they are acting on body members 114 and 116 to apply clamping pressure on opposing sides of ventilated rib 101.

Referring now to FIG. 3 which is an exploded pictorial view of gun sight mount 110 and rear sight 121. In practice, when mounting and assembling gun sight mount 110 and rear sight 121 to a ventilated rib, the elongate rib receiving groove 113 in first body member 114 of gun sight mount 110 is pressed into engagement with the ventilated rib and lip 112 is engaged with a support member of the ventilated rib. Dovetail 122 of rear sight 121 is then introduced into dovetail grooves 111 of body members 114 and 116 thereby aligning the two body members. Rib receiving groove 113 of second body member 116 is then pressed into engagement with the ventilated rib. Screews 115 are then passed through clearance holes 117 of second body member 116 and are threadably engaged in threaded holes 118 of first body member 114. As screws 115 are tightened the bottoms of rib receiving grooves 113 are brought into engagement with the lateral sides of the ventilated rib. Gun sight mount 110 is thereby securely fastened and accurately positioned and positively indexed to the shotgun barrel. Rear sight 121 is finally pressed or driven into proper position in the dovetail groove formed in the assembled mount by the juxtapositioning of grooves 111 of body members 114 and 116.

While the device of FIGS. 1 through 3 discloses and describes a preferred embodiment of this invention, many alternative configurations of this preferred embodiment are found to be practicable.

FIGS. 4 through 8 are representative of the alternative configurations of the preferred embodiment which are practicable.

Referring now to FIG. 4. Rear sight mount 150 comprises first body member 151, second body member 152 and roll pins 153. A ramp-like longitudinal dovetail 154 is formed on body member 152. Alignment pin 155 is fixed in body member 151 and is accurately alignable with a mating alignment hole 156 in body member 152. Body members 151 and 152 have rib receiving grooves 157 machined therein. Rib support engaging longitudinal ribs 158 form the lower edge of grooves 157. Ribs 158 have passing therethrough reamed roll pin holes 159.

In practice, the functions of; locating, aligning, indexing and clamping are achieved in a manner analogous to that discussed in conjunction with FIGS. 1 through 3.

Referring now to FIG. 5. Sight mount 160 comprises first body member 161, second body member 162 and screw fasteners 163. Sight mount 160 has its top surfaces 165 formed to create a ramp front sight mount. Locating, aligning, indexing and clamping are as herein previously discussed.

Referring now to FIG. 6. Sight mount 170 comprises one piece body member 178 and screw fasteners 173. Body 178 has lateral sight mounting dovetail groove 174 and longitudinal rib receiving groove 177 formed therein.

In practice body member 178 is placed in the desired location along the ventilated rib and pressed down onto said rib. The fit between the ventilated rib and rib receiving groove 177 being a close fit. Screw fasteners 173 are then passed through clearance holes 172 provided in the lower part of body member 178. Screw fasteners 173 then pass under the ventilated rib and engage in corresponding threaded holes 175 in the opposite side of body member 178. Sight mount 170 is then tapped forward along the rib until one of screw fasteners 173 engages a rib support. Screw fasteners 173 are then tightened and a sight is mounted in dovetail groove 174 in a manner similar to that previously discussed herein.

Referring now to FIG. 7. Sight mount 180 is similar to sight mounts previously described herein. Sight mount 180 is clamped by means of a single screw fastening means 185. Single threaded hole 188 is provided as a sight mounting means in substantially planer continuous top surface 181.

Referring now to FIG. 8. Sight mount 191 is similar to sight mounts previously discussed herein. The top surface 190 of sight mount 191 is not provided with a sight mounting means. A "blank" sight mount such as mount 191 provides the necessary mounting means and machinable material for mounting special or custom sights.

Figure 10:
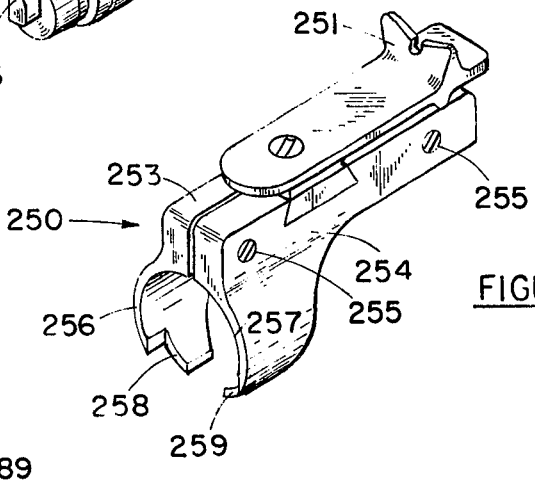
FIG. 10 is a pictorial view of the rear sight mount of FIG. 9.
Figure 11:
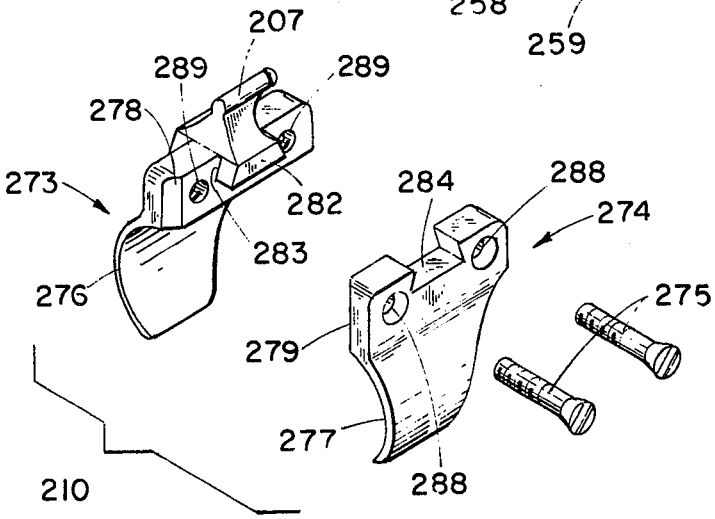
FIG. 11 is an exploded view of the front sight mount of FIG. 9.

Referring now to FIGS. 9 through 11. FIGS. 9 through 11 show a preferred embodiment of this invention which provides a means for mounting rifle-like sights to shotguns that are not provided with a ventilated rib. Many shotguns in use and on sale today are not provided with a ventilated rib. Most shotguns have fixed to their barrels a bead sight at the distal end of the barrel and a depending lug or other attachment means intermediate of the proximal and distal end of the barrel. This embodiment of the invention utilizes fixed projections on the barrel as a means of providing the sight mount with radial and longitudinal indexing as well as mechanical engagement.

The sight mount of this embodiment is configured to conform to the barrel taper and diameter as well as cooperate with physical shape of the projection with which it is to index and engage.

Referring now to FIG. 9. Shotgun 200 is provided with barrel 201 which has ball front sight 202 fixedly attached at its distal end and depending lug 203 fixedly attached intermediate the proximal and distal end of barrel 201. Front sight mount 210 is radially and axially indexed to and mechanically engaged with ball front sight 202. Front sight mount 210 is fixedly clamped to gun barrel 201. Post sight 207 is mounted to front sight mount 210. Rear sight mount 250 is radially and longitudinally indexed to and mechanically engaged with depending lug 203. Rear sight mount 250 is securely clamped to barrel 201. Rear V-sight 251 is mounted to rear sight mount 250.

Referring now to FIG. 10. Rear sight mount 250 comprises; first body member 253, second body member 254 and fastening screws 255. Body members 253 and 254 have as their lower elements arcuate barrel receiving members 256, and 257 respectively. Barrel receiving members 256 and 257 combine to form a circular arc of greater than 220° but less the 360°. The internal surface of barrel receiving members 256 and 257 are machined to conform to the slightly tapered tubular surface of the gun barrel at the point of attachment or rear sight mount 250 to the gun barrel. Barrel receiving members 256 and 257 have at their lower front corners lug receiving notches 258 and 259 respectively. The longitudinal edges of notches 258 and 259 engage the lateral sides of the depending lug of a shotgun barrel and thereby provide radial indexing to rear sight mount 250. The arcuate edges of notches 258 and 259 engage the rear surface of the depending lug of a shotgun barrel and thereby provide rear sight mount 250 with longitudinal indexing and mechanical engagement with the gun barrel. Rear V-sight 251 is mounted to the sight mount by means of a conventional dovetail and gib lock which is a part of the gun sight art and not a part of this invention, but serves to illustrate a means for projecting the sight rearward from the point of engagement of the sight mount with the depending lug of a gun barrel.

Referring now to FIG. 11. Front sight mount 210 comprises; first body member 273, second body member 274 and fastening screws 275. Body members 273 and 274 have as their lower portion arcuate barrel receiving members 276 and 277 respectively. Barrel receiving members 276 and 277 are machined to conform to the slightly tapered tubular surface of the gun barrel at the point of attachment of front sight mount 210. The upper front verticle edges of body members 276 and 277 have bevels 278 and 279 respectively. Bevels 278 and 279 combine to form a V-notch which is indexed to and engaged with the front ball sight of a shotgun. In practice, body member 273 is positioned along the gun barrel with bevel 278 aligned with the ball front sight. Dovetail 282 of post sight 207 is passed into and through dovetail groove 283 of body member 273. Dovetail groove 284 of body member 274 is then aligned with and engaged with dovetail 282 of post sight 207. Screw fasteners 275 are then passed through clearance holes 288 in body member 274 and are threadably engaged with threaded holes 289 of body member 273. When body members 273 and 274 are brought into close proximity to one another bevels 278 and 279 form a V-notch which is indexed to the front ball sight of the gun barrel. Screw fasteners 275 are then tightened and post sight 207 is pressed into position in the center of the sight mount.

In most instances this embodiment of the invention requires a slightly different mount for mounting the front sight than that which is used for mounting the rear sight. The differences in barrel geometries and indexes in the locations in which the sight mounts are to be attached necessitate corresponding modifications in sight mount geometries and indexes. Esthetic considerations and accommodations to sight styles often make it desirable to fabricate the sight mount of this invention as exclusively a front or exclusively a rear sight mount. However, it should be understood that it is within the scope of this invention to provide for many shotguns a detachable gun sight mount which is clampably attached to the barrel of the shotgun and which may be employed to mount either front or rear sights at the user's option.

In some manufacturers of shotguns there is little or no change in the diameter of the shotgun barrel over the front 50% or more of the barrel length.

Figure 12:
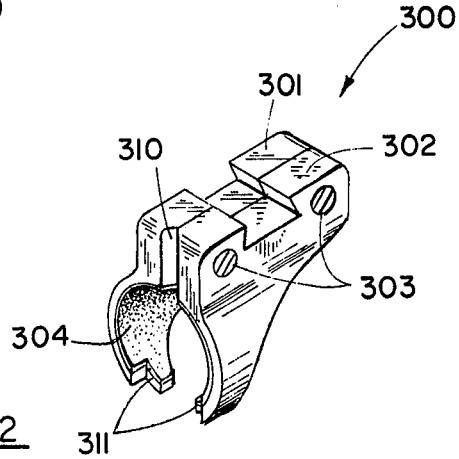
FIG. 12 is a pictorial view of a sight mount of this invention showing a mount configured so as to permit its use as either a front or rear sight mount.

Referring now to FIG. 12. Detachable sight mount 300 comprises first mount member 301, second mount member 302, screws 303 and mount liner 304.

Sight mount 300 has ball front sight engaging and indexing notch 310 as a part of its upper sight mounting portion. Sight mount 300 has depending lug engaging and indexing notches 311 as a part of its lower arcuate clamping portion. Sight mount 300 is additionally provided with a mount liner 304 which may be of plastic, rubber, adhesive or other suitable material. Mount liner 304 serves to buffer the gun barrel against marring which might result from direct contact between the sight mount and the gun barrel. Additionally mount liner 304 is slightly deformable and therefore will yield to permit slight variances in fit between the gun barrel and the sight mount.

Examples of preferred forms of the device of this invention are discussed in the specifications and shown in the drawings of this application. These examples are intended to be representative of the means for achieving the functions of indexing, engaging, clamping and mounting which are available in the art. To approach completeness in setting forth all applicable means for performing the functions of indexing, engaging, clamping, and mounting, would require that the specification be prolix and that the drawings and claims be greatly multiplied. Therefore, these exampls should be understood to be representative and in no way limiting.

What is claimed is:

1. A readily detachable gun sight mount which cooperates with a second gun sight mount of similar construction to provide a conventional shotgun with a mounting mans for mounting a pair of rifle-like sights to said shotgun without the need for modification of the shotgun barrel or its associated structures and said gun sight mount having a body comprising:

a. an upper sight mounting portion formed to mount a gun sight, b. a lower noncircumferential clamping portion for clampably attaching said gun sight mount to an existing longitudinal gun barrel structure, c. at least one portion of said gun sight mount having formed thereto an indexing means and an engaging means for mechanically engaging with and indexing to a gun barrel structure, and d. fastening means for maintaining said gun sight mount in clamping attachment with said gun barrel structure, and wherein said body comprises two body members; a first body member, and a second body member, and the lower portions of said body members are configured so that when said first body member is assembled with said second body member said lower portions combine to form a longitudinal groove which conforms to the geometries of a longitudinal segment of a gun barrel structure and said longitudinal groove is configured to embrace more than 60% but less than 100% of said longitudinal segment of said gun barrel structure.

2. The gun sight mount of claim 1 wherein said body members are guided into accurate alignment one with the other by an alignment means.

3. The gun sight mount of claim 2 wherein said alignment means are fixed elements of said body members.

4. The gun sight mount of claim 2 wherein said alignment means are fixed elements of said body members cooperating with elements of a gun sight.

5. The gun sight mount of claim 2 wherein said lower noncircumferential clamping portion is configured to conform to the geometries of a longitudinal segment of a ventilated rib of a shotgun.

6. The gun sight mount of claim 5 wherein said indexing means and said engaging means are a set of inward directed lip forming the lower portions of said longitudinal groove of said gun sight mount and said lips are insertible into at least one vent of said ventilated rib and said lips are engageable with a rib support of said ventilated rib.

7. The gun sight mount of claim 2 wherein said lower noncircumferential clamping portion is configured to conform to the geometries of a longitudinal segment of the substantially tubular gun barrel of a shotgun.

8. The gun sight mount of claim 7 wherein said body has a notch therein which is indexable to and engageable with a bead front sight of a shotgun.

9. The gun sight mount of claim 7 wherein said body has at least one notch therein which is indexable to and engageable with a depending lug of a shotgun barrel.

10. The gun sight mount of claim 2 wherein said gun sight mount is employable for mounting a front sight and said gun sight mount is equally employable for mounting a rear sight.

11. The gun sight mount of claim 2 wherein said longitudinal groove is provided with a thin lining of cushioning material such as rubber, plastic, adhesive and the like.

12. A readily detachable gun sight mount which cooperates with a second gun sight mount of similar construction to provide a conventional shotgun with a mounting means for mounting a pair of rifle-like sights to said shotgun and said gun sight mount is attachable and detachable by a person of ordinary mechanical skill using tools commonly found in home workshops and said gun sight mount comprises a two piece body having a first body member and a second body member and said body members having an upper sight mounting portion having formed therein a lateral dovetail groove for mounting a gun sight and said body members having a lower clamping portion having a longitudinal groove therein and said groove conforms to the geometries of a portion of a longitudinal segment of a ventilated rib of a shotgun and said longitudinal groove has at its lower portion at least one inward directed lip and said lip is insertible into a vent of said ventilated rib and said lip is engageable with a rib support of said ventilated rib and said first body member has at least one lateral threaded hole formed in its upper sight mounting portion and said second body member has at least one lateral clearance hole passing through its upper sight mounting portion and said clearance hole in said second body member is alignable with said threaded hole in said first body member and a threaded fastener is passed through said clearance hole and engaged in said threaded hole for the purpose of drawing said first body member towards said second body member and thereby bringing said longitudinal grooves in said first and second body members into clamping engagement with the lateral sides of said longitudinal segment of a ventilated rib.

13. A readily detachable gun sight mount which cooperates with a second gun sight mount of similar construction to provide a conventional shotgun with a mounting means for mounting a pair of rifle-like sights to said shotgun and said gun sight mount is attachable and detachable by a person of ordinary mechanical skill using tools commonly found in home workshops and said gunsight mount comprises a two piece body having a first body member and a second body member and said body members having an upper sight mounting portion having formed therein a lateral dovetail groove for mounting a gun sight and said body members having a lower clamping portion having a longitudinal arcuate groove therein and said arcuate groove conforms to the geometries of a portion of a longitudinal segment of the substantially tubular barrel of a shotgun and said arcuate longitudinal groove has at its lower portion at least one notch and said notch has at least one longitudinal surface and at least one arcuate surface and said notch is configured so that at least one longitudinal surface of said notch and at least one arcuate surface of said notch are mechanically indexable to and engagable with a depending fixed structure of said gun barrel and said body members further having said upper sight mounting portion provided with at least one notch which is mechanically engageable and indexable with a ball front sight of a shotgun and said first body member has at least one lateral threaded hole formed in its upper sight mounting portion and said second body member has at least one lateral clearance hole passing through its upper sight mounting portion and said clearance hole in said second body member is alignable with said threaded hole in said first body member and a threaded fastener is passed through said clearance hole and engaged in said threaded hole for the purpose of drawing said first body member towards said second body member and thereby bringing said longitudinal arcuate grooves of said first and second body members into clamping engagement with a longitudinal segment of said shotgun barrel.

* * * * *